US009285167B2

(12) United States Patent
Lee et al.

(10) Patent No.: US 9,285,167 B2
(45) Date of Patent: Mar. 15, 2016

(54) CLOTHES DRYER AND CONTROL METHOD THEREOF

(71) Applicant: SAMSUNG ELECTRONICS CO., LTD., Suwon-si, Gyeonggi-do (KR)

(72) Inventors: Bo Ram Lee, Suwon-si (KR); Hyun Sook Kim, Hwaseong-si (KR); So Jung Yu, Hwaseong-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 464 days.

(21) Appl. No.: 13/728,210

(22) Filed: Dec. 27, 2012

(65) Prior Publication Data

US 2013/0167398 A1 Jul. 4, 2013

(30) Foreign Application Priority Data

Dec. 30, 2011 (KR) ..... 10-2011-0147949

(51) Int. Cl.
*F26B 23/00* (2006.01)
*D06F 58/28* (2006.01)

(52) U.S. Cl.
CPC ..... *F26B 23/00* (2013.01); *D06F 58/28* (2013.01); *D06F 2058/2803* (2013.01); *D06F 2058/289* (2013.01); *D06F 2058/2829* (2013.01); *D06F 2058/2838* (2013.01); *D06F 2058/2893* (2013.01); *D06F 2058/2896* (2013.01)

(58) Field of Classification Search
CPC ..... D06F 58/28; D06F 58/203
USPC ..... 34/524–575
See application file for complete search history.

(56) References Cited

U.S. PATENT DOCUMENTS

| | | | | |
|---|---|---|---|---|
| 3,318,016 | A * | 5/1967 | Chafee, Jr. | 34/527 |
| 2009/0094854 | A1* | 4/2009 | Cimetta et al. | 34/562 |
| 2011/0030149 | A1* | 2/2011 | Cho | D06F 37/306 8/137 |

FOREIGN PATENT DOCUMENTS

| | | |
|---|---|---|
| CN | 1837453 A | 9/2006 |
| CN | 101410565 A | 4/2009 |
| KR | 10-2005-0042534 | 5/2005 |
| KR | 10-2006-0060226 | 6/2006 |
| KR | 10-2011-0045756 | 5/2011 |

OTHER PUBLICATIONS

Chinese Office Action mailed Dec. 3, 2015 in related Chinese Application No. 201210591975.7.

* cited by examiner

*Primary Examiner* — David J Laux
(74) *Attorney, Agent, or Firm* — Staas & Halsey LLP

(57) ABSTRACT

A clothes dryer capable of providing a dry course suitable for functional clothes, and a control method thereof, the control method including selecting functional clothes as a substance accommodated in a dry tub to be dried; performing a first dry process to dry the functional clothes at a first dry temperature; and performing a second dry process to dry the functional clothes at a second dry temperature higher than the first dry temperature.

11 Claims, 8 Drawing Sheets

CLOTHES DRYER AND CONTROL METHOD THEREOF

CROSS-REFERENCE TO RELATED APPLICATIONS

This application claims the benefit of Korean Patent Application No. 10-2011-0147949, filed on Dec. 30, 2011 in the Korean Intellectual Property Office, the disclosure of which is incorporated herein by reference.

BACKGROUND

1. Field

Embodiments of the present disclosure relate to a clothes dryer capable of providing a drying course suitable for functional clothes, and a control method thereof.

2. Description of the Related Art

A clothes dryer is an apparatus configured to dry a substance to be dried, such as washed clothes, by evaporating moisture contained in the substance. The clothes dryer operates in a hot wind scheme by rotating a dry tub (drum) at an inside a body of the clothes dryer while supplying heated wind to the inside of the dry tub to dry clothes.

The clothes dryer is mainly divided into an exhaust-type dryer and a condenser-type dryer. The exhaust-type dryer refers to a dryer to exhaust a high temperature and humidity air passed through the dry tub to the outside the dryer. The condenser-type dryer refers to a dryer to eliminate moisture from high temperature and humid air passed through the dry tub, and circulate the air having moisture removed therefrom into the dry tub again.

The clothes dryer provides various dry courses depending to the type of clothes, that is, depending on the type of fabric of the clothes. For example, the dry courses may include a standard course, a towel course, and an underwear course. As such, the clothes dryer provides various dry courses, so a user may be able to dry clothes by selecting a drying course suitable for the type of clothes.

However, the conventional clothes dryer as such fails to provide a dry course suitable for functional clothes, such as sportswear and mountaineering sportswear. In many cases, the functional clothes, such as sportswear and mountaineering sportswear, are formed of a moisture penetrating and water repellant material or a stretchy material. The functional clothes passing through a washing process may lose its own characteristic of the fabric, for example water repellant performance. If the functional clothes having the function degraded are dried at a temperature inappropriate for the fabric, the degraded function is not recovered or the shape of the clothes is deformed. Although a clothes dryer providing a dry course for synthetic fiber is present, the dry course for synthetic fiber proceeds at a low temperature unconditionally, thereby having a difficulty in obtaining a desired degree of dryness of the clothes.

SUMMARY

Therefore, it is an aspect of the present disclosure to provide a clothes dryer capable of providing a dry course suitable for functional clothes, and a control method thereof.

Additional aspects of the disclosure will be set forth in part in the description which follows and, in part, will be apparent from the description, or may be learned by practice of the disclosure.

In accordance with one aspect of the present disclosure, a method of controlling a clothes dryer is as follows. If a substance accommodated in a dry tub to be dried is functional clothes, a first dry process may be performed to dry the substance at a first dry temperature. A second dry process may be performed to dry the substance at a second dry temperature higher than the first dry temperature.

The functional clothes may include at least one of a moisture penetrating and water repellant material and a stretchy material.

The first dry temperature may be a temperature that recovers a water repellant function of the moisture penetrating and water repellant material. The second dry process may be performed during a second dry time, and the second dry time may be a period of time that prevents the stretchy material from being deformed when the stretch material is exposed to the second dry temperature.

The performing of the first dry process may be as follows. More than one heater may be turned on. A temperature at an inside of the dry tub may be maintained at the first dry temperature by repeating turning on and off the more than one heater, if the temperature at the inside of the dry tub reaches the first dry temperature.

The maintaining of the temperature at the inside of the dry tub at the first dry temperature may be as follows. A second heater having a power capacity larger than a first heater is turned on and off repeatedly in a state that the first heater is being turned on.

The performing of the second dry process may be as follows. An operation temperature of more than one heater may be raised if a degree of dryness of the substance reaches a target degree of dryness in the first dry process. A temperature at an inside of the dry tub may be maintained at the second dry temperature by repeating turning on and off the more than one heater, if the temperature at the inside of the dry tub reaches the second dry temperature.

The maintaining of the temperature at the inside of the dry tub at the second dry temperature may be as follows. A second heater having a power capacity larger than a first heater may be turning on and off repeatedly in a state that the first heater is being turned on.

In accordance with the present disclosure, a clothes dryer includes a dry tub, and a control unit. The dry tub may be configured to accommodate a substance to be dried. The control unit may be configured to sequentially perform a first dry process to dry the substance at a first dry temperature and a second dry process to dry the substance at a second dry temperature higher than the first dry temperature, if the substance is functional clothes.

The functional clothes may include at least one of a moisture penetrating and water repellant material and a stretchy material.

The first dry temperature may be a temperature that recovers a water repellant function of the moisture penetrating and water repellant material. The second dry process may be performed during a second dry time, and the second dry time may be a period of time that prevents the stretchy material from being deformed when the stretch material is exposed to the second dry temperature.

The control unit may perform the first dry process by turning on more than one heater, and maintaining the temperature at an inside of the dry tub at the first dry temperature by repeating turning on and off the more than one heater, if a temperature at the inside of the dry tub reaches the first dry temperature by the more than one heater.

The control unit may maintain the temperature at the inside of the dry tub at the first dry temperature by repeating turning on and off a second heater having a power capacity larger than a first heater in a state that the first heater is being turned on.

The control unit may perform the second dry process by raising an operation temperature of more than one heater if a degree of dryness of the substance reaches a target degree of dryness in the first dry process, and maintaining the temperature at an inside of the dry tub at the second dry temperature by repeating turning on and off the more than one heater, if the temperature at the inside of the dry tub reaches the second dry temperature.

The control unit may maintain the temperature at the inside of the dry tub at the second temperature by repeating turning on and off a second heater having a power capacity larger than a first heater in a state that the first heater is being turned on.

As described above, a dry course suitable for functional clothes is provided, so that the function of the functional clothes degraded while passing through a washing process is recovered.

In a case of functional clothes being dried according to a dry course suitable for the functional clothes, when compared to a dry course that unconditionally proceeds with drying, the shape of the functional clothes is prevented from being deformed.

In a case of clothes being dried according to a dry course suitable for the clothes, when compared to a dry course that unconditionally proceeds with drying, an improved degree of dryness is obtained.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
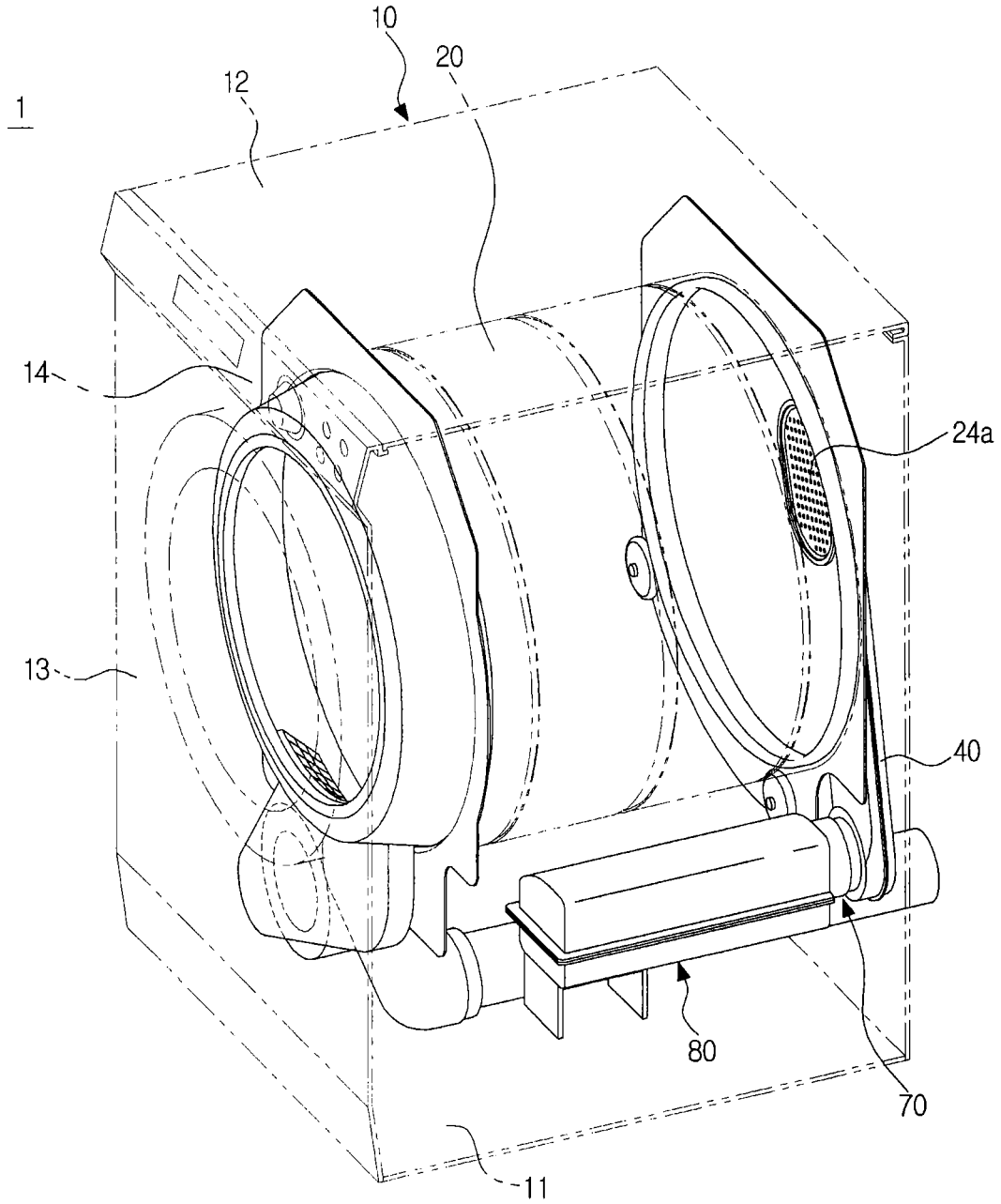
FIG. 1 is a perspective view illustrating a clothes dryer in accordance with one embodiment of the present disclosure.

Reference will now be made in detail to the embodiments of the present disclosure, examples of which are illustrated in the accompanying drawings, wherein like reference numerals refer to like elements throughout.

Figure 2:
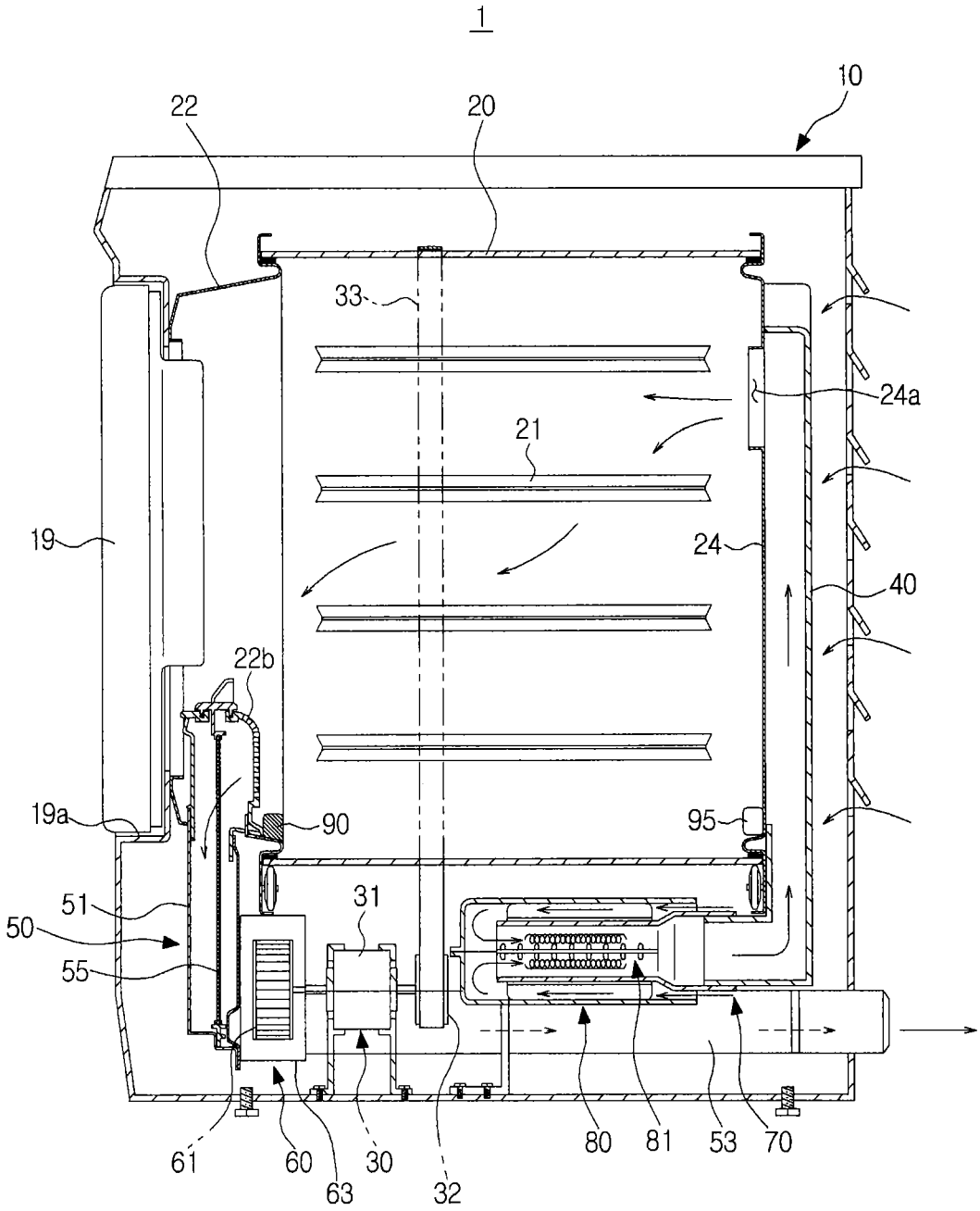
FIG. 2 is a cross sectional view illustrating of the clothes dryer of FIG. 1.

FIG. 1 is a perspective view illustrating a clothes dryer in accordance with one embodiment of the present disclosure. FIG. 2 is a cross sectional view illustrating the clothes dryer of FIG. 1.

Referring to FIGS. 1 and 2, a clothes dryer 1 in accordance with one embodiment of the present disclosure includes a body 10, a dry tub 20, a drying apparatus 30, and a hot air duct 70.

The body 10 is provided in an approximately hexahedron shape. The body 10 may include a cabinet 11, a top cover 12 to cover an upper portion of the cabinet 11, a front side panel 13 disposed at a front of the cabinet 11, and a control panel 14. At the control panel 14, an input unit (110 in FIG. 3) and a display unit (140 in FIG. 3) may be disposed. The input unit 110 may include various buttons to control the clothes dryer 1. The display unit 140 may display the status of operation of the clothes dryer 1. The input unit 110 may be separately implemented from the display unit 140 in a hardware aspect, and may be implemented as an integrated form, such as a touch screen, in a hardware aspect.

The dry tub 20 is a space where a substance is dried, and the dry tub 20 is rotatably installed at an inside of the body 10. The dry tub 20 is provided in the form of a cylinder having a front surface and a rear surface thereof open. At an inside of the dry tub 20, a plurality of lifters 21 is provided to lift and drop the substance. At an inner side of a front surface portion of the body 10, a front side support panel 22 is installed, and at an inner side of a rear surface portion of the body 10, a rear side support panel 24 is installed. The front side support panel 22 and the rear side support panel 24 support a front side opening and a rear side opening of the dry tub 20, respectively, so that the dry tub 20 is rotated. A dry tub air intake port 24*a* is formed at an upper portion of the rear side support panel 24.

An inlet 19*a* is formed at the front surface of the body 10 and the front side support panel 22 to allow the substance to be introduced and withdrawn to/from the inside of the dry tub 20. A door 19 is installed at the front surface of the body 10 to open and close the inlet 19*a*.

The driving apparatus 30 includes a driving motor 31, a pulley 32 and a rotating belt 33. The driving motor 31 is installed at a lower portion at the inside of the cabinet 10. The pulley 32 and the rotating belt 33 serve to deliver a driving force of the driving motor 31 to the dry tub 20. The pulley 32 is coupled to the outer surface of the dry tub 20 and a shaft of the driving motor 31. The rotating belt 33 is installed to be wound around the pulley 32.

The hot air duct 70 may include a heating unit 80 and a hot air supply unit 40.

The heating unit 80 is installed at a lower portion of the dry tub 20 to heat the air being introduced from the outside. The heating unit 80 includes a heater 81 to radiate heat toward the inside of the heating unit 80. The heater 81 installed at the heating unit 80 may be implemented using a coil heater. The heater may be provided in a plurality thereof. Each of the plurality of heaters may have a different power capacity. For example, when assumed that the total power capacity is 5.3 kW (100%), a heater having a smaller power capacity of about 1.6 kW (30%) and a heater having a larger power capacity of about 3.7 kW (70%) may be used. In this case, the ratio of the heater having a smaller capacity to the heater having a larger capacity is not limited to 3:7, and may vary in accordance with embodiments of the present disclosure. Hereinafter, for the convenience of description, the heater having a smaller power capacity is referred to as 'a first heater', and the heater having a larger power capacity is referred to as 'a second heater'.

The hot air supply unit 40 forms an air passage by connecting the heating unit 80 to the dry tub intake port 24*a* formed at the upper portion of the rear side support panel 24. The hot air supply unit 40 serves to guide air, being heated by the heating unit 80, to the dry tub 20.

Meanwhile, an exhaust duct 50 is connected to a lower portion of the front side of the dry tub 20. The exhaust duct 50 serves to guide air of inside of the dry tub 20 to be exhausted to the outside. The exhaust duct 50 includes a front side exhaust duct 51 and a rear side exhaust duct 53.

The front side exhaust duct 51 connects an exhaust port 22*b* installed at a lower portion of the front side support panel 22 to an entry of a blower apparatus 60 installed at a lower portion of the dry tub 20. A filter member 55 is installed at the front side exhaust duct 51. The filter member 55 filters foreign substance, such as dust or lint, included in the hot air being discharged from the dry tub 20.

The rear side exhaust duct 53 is installed at a lower portion of the cabinet 11, and allows an exit of the blower apparatus 60 to communicate with the outer side of a rear surface portion of the cabinet 11.

The blower apparatus 60 includes a blower fan 61 and a blower case 63. The blower fan 61 is installed at a front side of a lower portion of the dry tub 20 to circulate air. The blower case 63, while surrounding the blower fan 61, is connected to the front side exhaust duct 51 and the rear side exhaust duct 53.

A dryness sensor 90 is installed at a lower end portion of the front surface of the dry tub 20. The dryness sensor 90 makes contact with the substance to be dried at the dry tub 20 as the dry tub 20 rotates, and senses the amount of moisture contained in the substance. An output value of the dryness sensor 90 is used to the degree of dryness of the substance. In detail, the output value being output from the dryness sensor 90 varies depending on the amount of moisture contained in the substance. By comparing an output vale being output from the sensor 90 with an output value stored in advance, the degree of dryness may be determined. To this end, the dryness sensor 90 may include a touch sensor provided in the form of a plate bar.

A temperature sensor 95 is installed at a lower end portion of the rear surface of the dry tub 20. The temperature sensor 95 may sense the temperature of air inside the dry tub 20.

Figure 3:
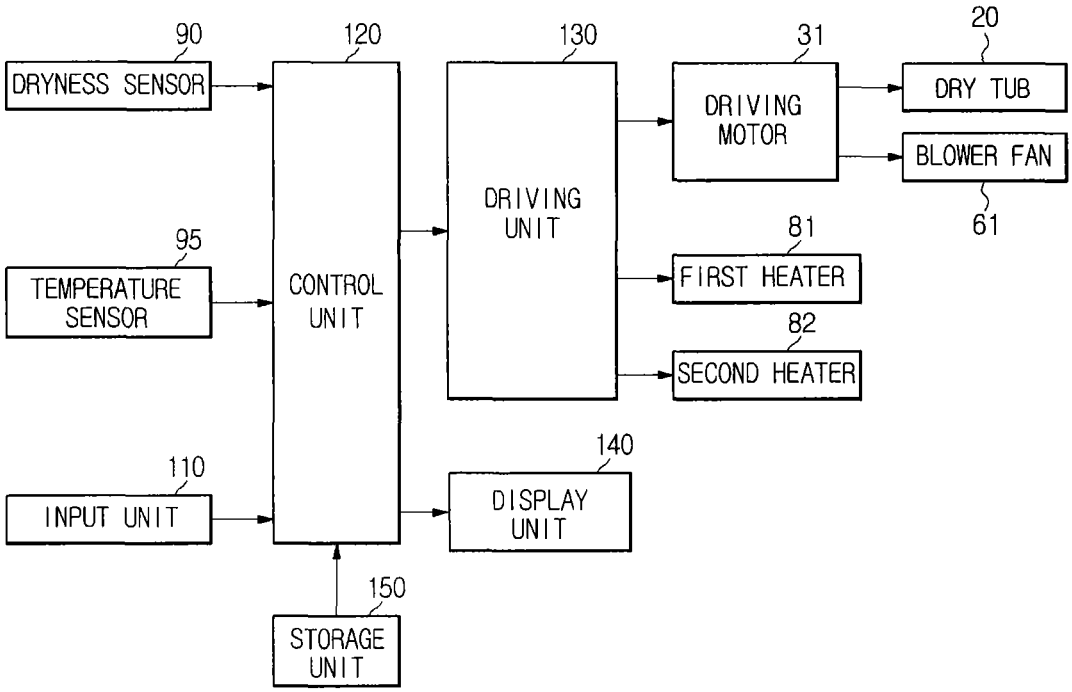
FIG. 3 is a control block diagram of the clothes dryer in accordance with one embodiment of the present disclosure.

FIG. 3 is a control block diagram of the clothes dryer in accordance with one embodiment of the present disclosure.

Referring to FIG. 3, the clothes dryer 1 in accordance with one embodiment of the present disclosure includes the dryness sensor 90, the temperature sensor 95, the input unit 110, the control unit 120, a driving unit 130, the driving motor 31, the first heater 81, the second heater 82, the dry tub 20, the blower fan 61 and the display unit 140.

The dryness sensor 90 makes contact with the substance of the inside of the dry tub 20 to sense the amount of moisture being contained in the substance. An output value of the dryness sensor 90 depending on the result of sensing is transmitted to the control unit 120.

The temperature sensor 95 senses the temperature of air of the inside of the dry tub 20. An output value of the temperature sensor 95 depending on the result of sensing is transmitted to the control unit 120.

The input unit 110 is received with a command to control the operation of the clothes dryer 1. To this end, the input unit 110 may include various buttons. For example, a dry mode selection button to select one of a manual dry or an automatic dry, a number button to select the temperature or the time for drying the substance in a case when the manual dry is selected, and a dry course selection button to select a dry course in a case when the automatic dry is selected. The dry course includes a standard course, a towel course, an underwear course, a synthetic fiber course and a particular material course.

The standard course is a dry course suitable for a general dry, and the towel course is a dry course to dry a towel or a substance formed of cotton at a high temperature. The underwear course is a dry course suitable for drying a thin fabric such as underwear, and the synthetic fiber course is a dry course suitable for drying a substance formed of synthetic fiber. The particular material course is a dry course suitable for functional clothes formed of a particular material, such as a moisture penetrating and water repellent material or a stretch material. The time and temperature for drying may be set to be different at each course.

The various buttons provided at the input unit 110 may include at least one of a press-in type button and a rotation type button. For example, the dry mode selection button or the number button may be implemented as a press-in type button, and the dry course selection button may be implemented as a rotation type button.

A jog dial may be provided at the input unit 110 besides the buttons described above, to select a state of dryness. The state of dryness may include a semi-drying and a full-drying.

The control unit 120 generates a control signal according to a command being input through the input unit 110, and controls the overall operation of the clothes dryer 1 according to the generated control signal. For example, if a standard course is selected among the dry courses in accordance with the type of the substance, the control unit 120 measures the degree of dryness of the substance through the dryness sensor 90, and perform a dry process during a predetermined period of time for drying while adjusting the temperature of drying according to the measured degree of dryness.

If the particular material course is selected among the dry courses, the control unit 120 controls the overall operation of the clothes dryer 1 according to an algorithm corresponding to the particular material course.

The particular material may refer to a moisture penetrating and water repellant material or a stretch material. The stretch material may refer to fiber or fabric having expansion and contraction, such as polyurethane. The moisture penetrating and water repellant material may refer to material having a membrane formed by extending and heating a teflon based resin, which is strong against heat or chemicals. The membrane has a plurality of small pores that allows interior moisture, such as sweat, to penetrate therethrough while preventing the penetration of exterior water. Since the pore has a size of about 2/10,000 mm, the pore prevents a rain drop having a size of 1 mm at the minimum from penetrating while allowing water vapor having a size of about 4/10,000,000 mm to pass through. The membrane may be referred to as GORE-TEX, a trademark of W.L. Gore and Associates, the inventor of the membrane.

When the functional clothes formed of the moisture penetrating and water repellant material is subject to a washing process, the water repellant function may be degraded. If the functional clothes having the water repellant function degraded are dried at a high temperature, the degraded water repellant function may be recovered to some degree. However, in a case that functional clothes including stretchy material are unconditionally dried at a high temperature to recover the water repellant function, the shape of the functional clothes is deformed.

Accordingly, when the particular material course is selected, the control unit 120 performs two stages of dry processes each having a different dry temperature. In this manner, the water repellent performance of the functional clothes degraded by the washing process is recovered while minimizing the deformation of the functional clothes if the functional clothes are formed of stretch material.

Figure 4:
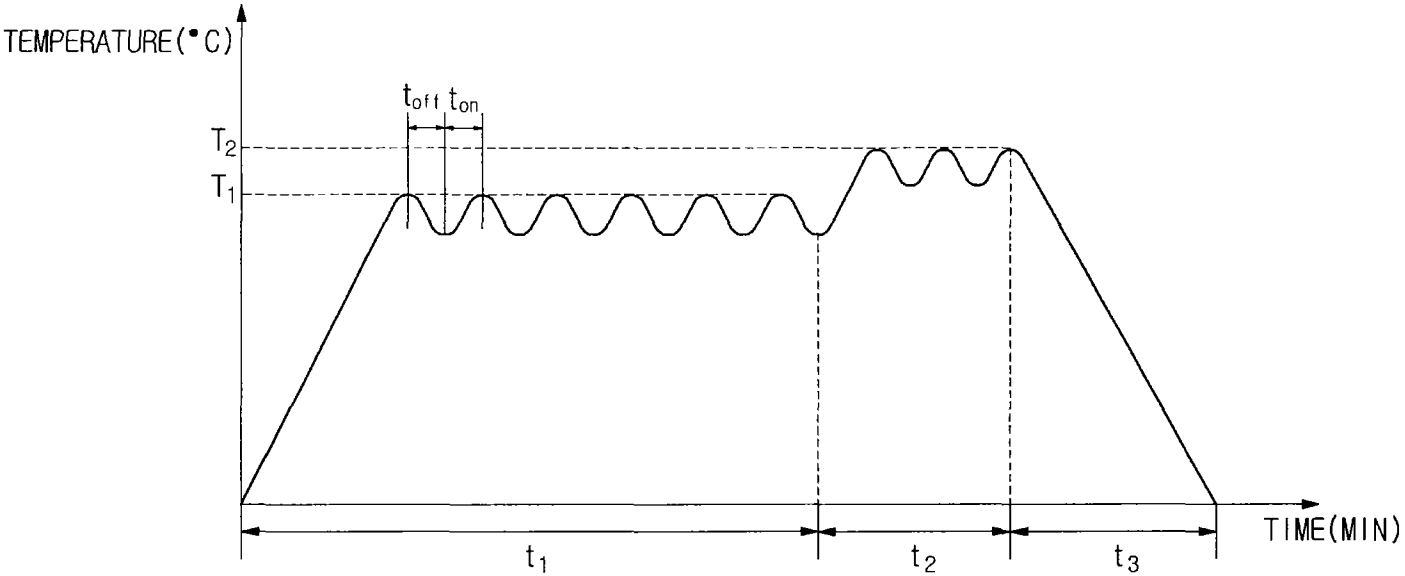
FIG. 4 is a graph showing the change in temperature at an inside a dry tub according to the time in a case that a particular material course is selected in the clothes dryer of FIG. 3.

Referring to FIG. 4, a control process of the clothes dryer 1 when the particular material course is selected will be described in detail. FIG. 4 is a graph showing the change in temperature at an inside a dry tub according to the time in a case that the substance is controlled according to the particular material course.

If the particular material course is selected, the control unit 120 starts a first dry process. To this end, the control unit 120 turns on the first heater 81 and the second heater 82. As such, the two heaters 81 and 82 are simultaneously turned on, so that the temperature of the inside of the dry tub 20 rapidly reaches a first dry temperature ($T_1$). Thereafter, the temperature at the inside of the dry tub 20 95 is measured using the temperature sensor, and if the temperature of the inside of the dry tub 20 reaches the first dry temperature ($T_1$), the control unit 120 repeats turning on and off the second heater 82 to maintain the temperature of the inside of the dry tub 20 at the first dry temperature ($T_1$). As shown in FIG. 4, the repeated on/off of the second heater 82 enables the temperature of the inside of the dry tub 20 to be maintained at the first dry temperature ($T_1$). Thereafter, the degree of dryness of the substance is measured by use of the dryness sensor 90, and when the measured degree of dryness reaches a target degree of dryness, the control unit 120 starts a second dry process after passing a first dry time ($t_1$) that is allocated to the first dry process.

In order to start the second dry process, the control unit 120 turns on the second heater 82. If a current state is that the second heat 82 is being turned off in the first dry process, the control unit 120 turns on the second heater 82. If a current state is that the second heat 82 is being turned on in the first dry process, the control unit 120 starts the second dry process by maintaining the-On state of the second heater 82. After the second heater 92 is turned on as such, the temperature of the inside of the dry tub 20 is measured using the temperature sensor 95, and if the temperature of the inside of the dry tub 20 reaches a second dry temperature ($T_2$), the control unit 120 repeats turning on and off the second heater 82 to maintain the second dry temperature ($T_2$). Referring to FIG. 4, the repeated on/off of the second heater 82 enables the temperature of inside the dry tub 20 to be maintained at the second dry temperature ($T_2$).

If a second dry time ($t_2$) allocated to the second dry process has passed after the second dry process starts, the control unit 120 performs a cooling process. The cooling process is performed by turning off the first heater 81 and the second heater 82, and operating the blower fan 61. The ratio of time periods allocated to the first dry process, the second dry process and the cooling process is about 3:1:1 in the total time ($t_1+t_2+t_3$), allocated to the particular material course. However, the ratio ($t_1:t_2:t_3$) of the first dry time, the second dry time, and the cooling time is not limited thereto, and may vary in according to embodiments. The time ($t_2$) allocated to the second dry process is desired to be shorter than the time ($t_1$) allocated to the first dry process.

The driving unit 130 operates the driving motor 31, the first heater 81 and the second heater 82, which are related to the operation of the clothes dryer 1, according to the control signal of the control unit 120.

The blower fan 130 is installed at the front side of the lower portion of the dry tub 20, to circulate the air. In a case of the cooling process being performed, the first heater 81 and the second heater 82 are turned off, and the blower fan 61 only operates. In this case, the blower fan 61 discharges the high temperature air inside the dry tub 20 to the outside.

The display unit 140 may be provided on the control panel 14. The display unit 140 may display the operation state of the clothes dryer 1. The display unit 140 may be separately implemented from the input unit 110 in a hardware aspect. Alternatively, the display unit 140 and the input unit 110 may be implemented as an integrated body, such as a touch screen, in a hardware aspect.

The storage unit 150 may store algorithms or data needed to control the operation of the clothes dryer 1. For example, the storage unit 150 may store an algorithm corresponding to each dry course, and data needed to perform a dry process according to each algorithm. The data may include the first dry temperature ($T_1$), the second dry temperature ($T_2$), the first dry time ($t_1$) allocated to the first dry process, the second dry time ($t_2$) allocated to the second dry process, and the cooling time ($t_3$) allocated to the cooling process. In this case, the second dry temperature ($T_2$) may be higher than the first dry temperature ($T_1$). For example, the first dry temperature ($T_1$) may be 61 to 62° C., and the second dry temperature ($T_2$) may be 67° C. The second dry time ($t_2$) may be shorter than the first dry time ($t_1$). For example, the first dry time ($t_1$) may be about 24 minutes, and the second dry time ($t_2$) may be about 8 minutes. The cooling time ($t_3$) may be equal to or shorter than the second dry time ($t_2$).

The storage unit 150 to store the algorithm or the data described above may be implemented as a non-volatile memory device, such as a Read Only Memory (ROM), a Random Access Memory (RAM), a Programmable Read Only Memory (PROM), an Erasable Programmable Read Only Memory (EPROM), and a flash memory; a volatile memory device such as a Random Access Memory (RAM); hard disks; or optical disks. However, the storage unit 150 of the present disclosure is not limited thereto, and may be implemented in various forms generally know in the art.

Figure 5:
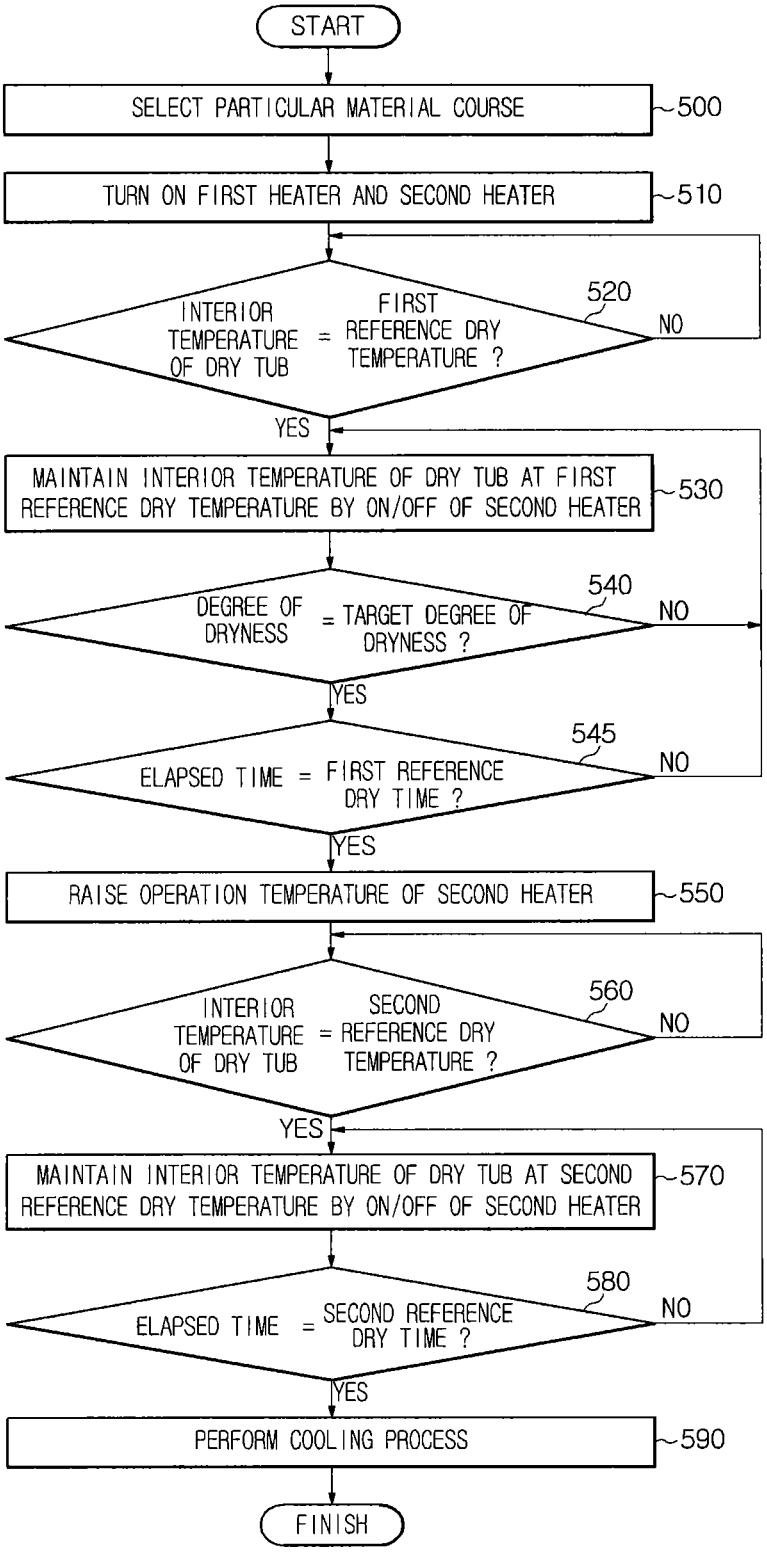
FIG. 5 is a flow chart illustrating a control process of the clothes dryer in accordance with one embodiment of the present disclosure.

FIG. 5 is a flow chart illustrating a control process of the clothes dryer in accordance with one embodiment of the present disclosure.

If the particular material course is selected (500), the control unit 120 starts the first dry process by turning on the first heater 81 and the second heater 82 (510). Since the first heater 81 and the second heater 82 are simultaneously turned on, the time taken for the temperature of the inside of the dry tub 20 to reach the first dry temperature ($T_1$) is reduced.

If the first heater 81 and the second heater 82 are turned on in operation 510, the temperature of the inside of the dry tub 20 is measured. The control unit 120 determines whether the temperature measured by the temperature sensor 95 reaches the first dry temperature ($T_1$) (520).

If a result of determination in operation 520 is that the temperature at the inside of the dry tub 20 does not reach to the first dry temperature ($T_1$), the control unit 120 keeps monitoring the temperature measured through the temperature sensor 95.

If a result of determination in operation 520 is that the temperature at the inside of the dry tub 20 reaches the first dry temperature ($T_1$), the control unit 120 allows the temperature at the inside of the dry tub 20 to be maintained at the first dry temperature ($T_1$) (530) by repeating turning on and off the second heater 82 having a larger power capacity. In detail, as a predetermined period of time ($t_{off}$) passes after the second heater 82 having been turned on in operation 510 is turned off, the temperature at the inside of the dry tub 20 is lowered to some degree. If so, the control unit 120 turns on the second heater 82 again, and after a predetermined period of time ($t_{on}$), the temperature at the inside of the dry tub 120 is raised again. As such, the control unit 120 repeats turning on and off the second heater 82 to control such that the temperature at the inside of the dry tub 20 is maintained at the first dry temperature ($T_1$). By turning on/off the second heater 82 in a state that the first heater 81 is being turned on, the temperature at the inside of the dry tub 20 is rapidly changed when compared to turning on/off the first heater 81.

After operation 530, the control unit 120 determines whether the degree of dryness of the substance contained in the dry tub 200 reaches to a target degree of dryness, based on the result of measurement of the dryness sensor 90.

If a result of determination in operation 540 is that the degree of dryness measured by the dryness sensor 90 does not reach to the target degree of dryness, the control unit 120 repeats turning on and off the second heater 82 such that the temperature at the inside of the dry tub 20 is maintained at the first dry temperature ($T_1$).

If a result of determination in operation 540 is that the degree of dryness measured by the dryness sensor 90 reaches the target degree of dryness, the control unit 120 determines whether a first dry time ($t_1$) elapses after a first dry process starts (545).

If a result of determination in operation 545 is that the first dry time ($t_1$) does not pass after the first dry process starts (NO from operation 545), the control unit 120 maintains the temperature at the inside of the dry tub 200 at the first dry temperature ($T_1$) until the first dry time ($t_1$) passes. The reason why the first dry time ($t_1$) needs to wait to pass even after the degree of dryness of the substance reaches the target degree of dryness is to cover inaccuracy of the dryness sensor. That is, when the degree of dryness is measured using the dryness sensor, the measured value may be inaccurate. Accordingly, even if the target degree of dryness is achieved, the first dry process continues until the first dry time passes.

If a result of determination in operation 545 is that the first dry time ($t_1$) passes after the first dry process starts (YES from operation 545), the control unit 120 raises the operation temperature of the second heater 82 (550) to start the second dry process. The reason why the operation temperature of the second heater 82 is raised is to raise the temperature at the inside of the dry tub 20 from the first dry temperature ($T_1$) from the first dry temperature ($T_1$) to the second dry temperature ($T_2$).

Thereafter, the control unit 120 determines whether the temperature at the inside of the dry tub 20 measured by the temperature sensor 95 reaches the second dry temperature ($T_2$) (560).

If a result of determination in operation 560 is that the temperature at the inside of the dry tub 20 does not reach to the second dry temperature ($T_2$), the control unit 120 keeps monitoring the temperature being measured by the temperature sensor 95.

If a result of determination in operation 560 is that the temperature at the inside of the dry tub 20 reaches the second dry temperature ($T_2$), the control unit 120 controls such that the temperature at the inside of the dry tub 20 is maintained at the second dry temperature ($T_2$) by repeating turning on and off the second heater 82 (570).

After operation 570, the control unit 120 determines whether a second dry time ($t_2$) allocated to the second dry process passes after the second dry process starts (580).

If a result of determination in operation 580 is that the second dry time ($t_2$) does not pass after the second dry process starts, the control unit 120 controls such that the temperature at the inside of the dry tub 20 is maintained at the second dry temperature ($T_2$) by repeating turning on and off the second heater 82 (570).

If a result of determination in operation 580 is that the second dry time ($t_2$) passes after the second dry process starts, the control unit 120 controls the operation of the clothes dryer 1 such that the cooling process is performed (590). In the cooling process, the first heater 81 and the second heater 82 are turned off, and only the blower fan 61 operates. By only operating the blower fan 61, the heat inside the dry tub 20 is discharged to the outside the clothes dryer 1, so that the temperature at the inside of the dry tub 20 is lowered.

Meanwhile, in the process of controlling the clothes dryer 1 as such, the reference temperatures $T_1$ and $T_2$ to determine the temperature at the inside of the dry 20 may be different from control temperatures that are output from the control unit 120 to operate one of the two heaters 81 and 82.

For example, although the first dry temperature ($T_1$) used to determine the temperature at the inside of the dry tub 20 in operation 520 of FIG. 5 has been described as about 61 to 62° C., a first control temperature being output from the control unit 120 to operate the two heaters 81 and 82 may be about 54° C.

For example, although the second dry temperature ($T_2$) used to determine the temperature at the inside of the dry tub 20 in operation 560 of FIG. 5 has been described as about 67° C., a second control temperature being output from the control unit 120 to operate the second heat 82 may be about 55° C. In this case, the information about the first control temperature and the second control temperature may be stored in the storage unit 150. In this case, the first control temperature and the second control temperature may be stored in the form of a mapping table including the mapping relation between the first dry temperature ($T_1$) and the second dry temperature ($T_2$).

Figure 6:
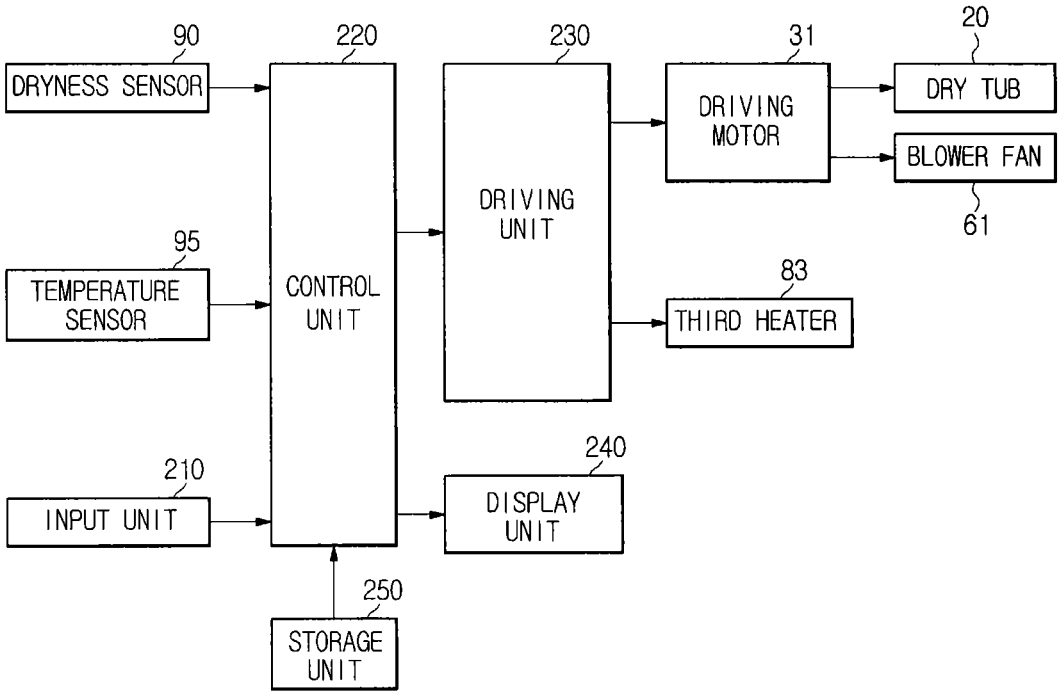
FIG. 6 is a control block diagram of a clothes dryer in accordance with another embodiment of the present disclosure.

FIG. 6 is a control block diagram of a clothes dryer in accordance with another embodiment of the present disclosure.

Referring to FIG. 6, a clothes dryer in accordance with another aspect of the present disclosure includes the dryness sensor 90, the temperature sensor 95, an input unit 210, a control unit 220, a driving unit 230, the driving motor 31, a third heater 83, the dry tub 20, the blower fan 61 and a display unit 240. The components of the clothes dryer in accordance with another embodiment of the present disclosure except for the third heater 83 have the same configurations as those of the clothes dryer of FIG. 3, so the description thereof will be omitted.

The clothes dryer shown in FIG. 6 is different from the clothes dryer shown in FIG. 3 in the number of heaters. The clothes dryer of FIG. 6 includes only the third heater 83 while the clothes dryer of FIG. 3 includes the first heater 81 having a smaller power capacity and the second heater 82 having a larger power capacity.

The third heater 83 has a power capacity that is equal to or larger than that of the second heater 82 of FIG. 3.

Figure 7:
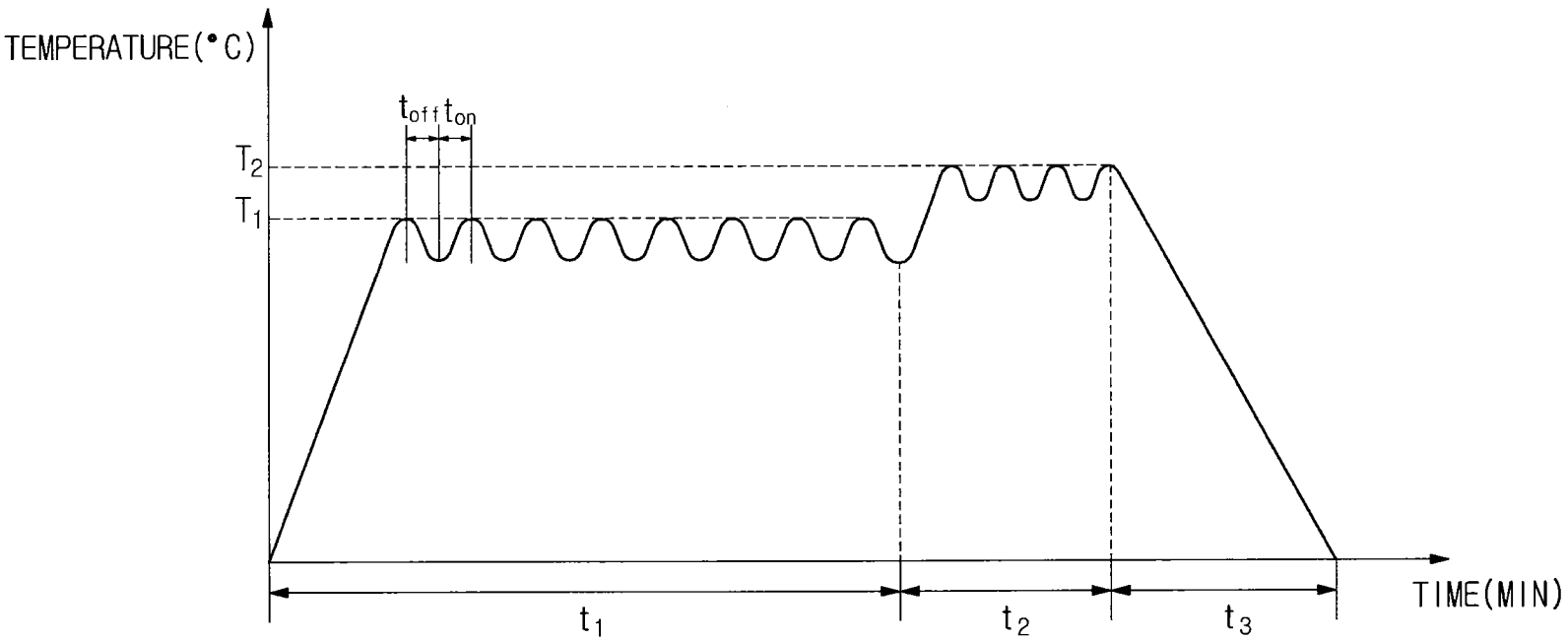
FIG. 7 is a graph showing the change in temperature at an inside a dry tub according to the time in a case that a particular material course is selected in the clothes dryer of FIG. 6.

The control unit 220, if the particular material course is selected among the dry courses according to the type of substance, performs two stages of dry courses each having a different dry temperature. Hereinafter, the control process of the clothes dryer when the particular material course is selected will be described with reference to FIG. 7. FIG. 7 is a graph showing the change in temperature at an inside of the dry tub 20 according to the time in a case that the drying of the substance is controlled according to the particular material course.

If the particular material course is selected, the control unit 220 starts a first dry process. To this end, the control unit 220 turns on the third heater 83. Thereafter, the temperature at the inside of the dry tub 20 is measured by the temperature sensor 95, and if determined that the temperature at the inside of the dry tub 20 reaches the first dry temperature ($T_1$), the control unit 220 maintains the first dry temperature ($T_1$) by repeating turning on and off the third heater 83. As shown in FIG. 7, the temperature at the inside of the dry tub 20 is shown to be maintained at the first dry temperature ($T_1$) as the third heater 83 is repeated between on and off. The degree of dryness of the substance is measured by the dryness sensor 90, and if a result of measurement is that a degree of dryness of the substance reaches a target degree of dryness, the control unit 220 starts a second dry process after a first dry time ($t_1$) allocated to the first dry process.

In order to start the second dry process, the control unit 220 raises the operation temperature of the third heater 83. Thereafter, the temperature at the inside of the dry tub 20 is measured by the temperature sensor 95, and if the temperature at the inside of the dry tub 20 reaches a second dry temperature ($T_2$), the control unit 220 repeats turning on and off the third heater 83 to maintain the temperature of the inside of the dry tub 20 at the second dry temperature ($T_2$). As shown in FIG. 7, the temperature at the inside of the dry tub 20 is shown to be maintained at the second dry temperature ($T_2$) as the third heater 83 is repeated between on and off.

If a second dry time ($t_2$) allocated to the second dry process passes after the second dry process start, the control unit 220 performs a cooling process. The cooling process is performed by turning off the third heater 83, and operating the blower fan 61.

Figure 8:
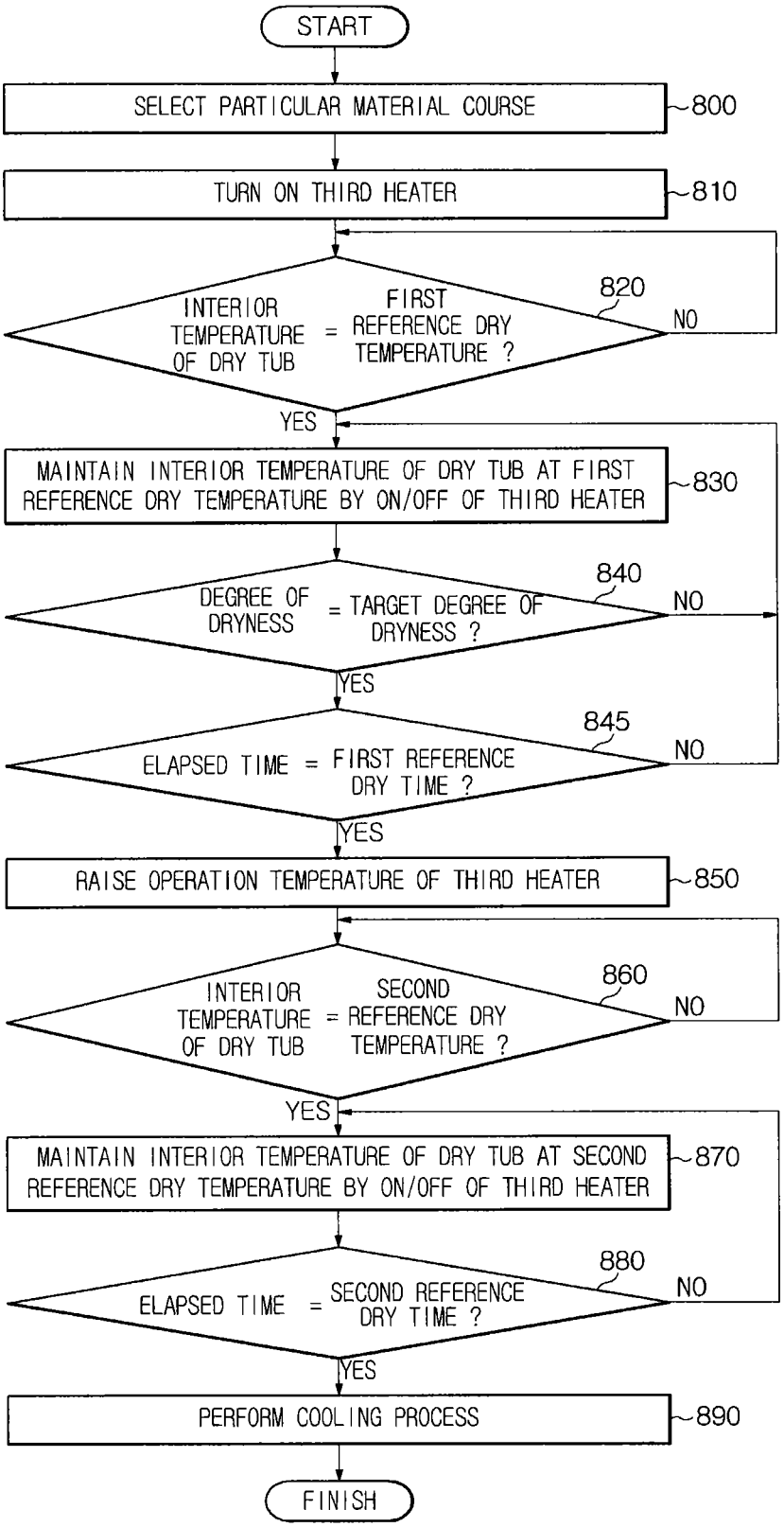
FIG. 8 is a flow chart illustrating a control process of the clothes dryer of FIG. 6.

FIG. 8 is a flow chart illustrating a control process of the clothes dryer of FIG. 6.

If the particular material course is selected (800), the control unit 220 turns on the third heater 83 to start the first dry process (810).

If the third heater 83 is turned on in operation 810, the temperature at the inside of the dry tub 20 is measured by the temperature sensor 95. The control unit 220 determines whether the temperature being measured by the temperature sensor 95 reaches the first dry temperature ($T_1$) (820).

If a result of determination in operation 820 is that the temperature at the inside of the dry tub 20 does not reach to the first dry temperature ($T_1$), the control unit 220 keeps monitoring the temperature measured by the temperature sensor 95.

If a result of determination in operation 820 is that the temperature at the inside of the dry tub 20 reaches the first dry temperature ($T_1$), the control unit 220 maintains the temperature at the inside of the dry tub 20 at the first dry temperature ($T_1$) by repeating turning on and off the third heater 83 (830). In detail, the third heater 83 having been turned on in operation 810 is turned off, and if a predetermined period of time ($t_{off}$) passes, the temperature of the inside of the dry tub 20 is lowered to some degrees. If so, the control unit 220 turns on the third heater 83 again. If a predetermined period of time ($t_{on}$) passes after the third heater 83 is turned on, the temperature at the inside of the dry tub 20 is raised again. In this manner, the control unit 220 periodically turns on and off the third heater 83 to control such that the temperature at the inside of the dry tub 20 is maintained at the first dry temperature ($T_1$). In this case, the time during which the third heater 83 is turned on or turned off may be shorter than the time during which the second heater 82 is turned on or turned off in the previous embodiment of the present disclosure.

After operation 830, the control unit 220 determines whether a degree of dryness of a substance contained in the dry tub 200 reaches a target degree of dryness based on a result of measurement of the dryness sensor 90 (840).

If a result of determination in operation 840 is that the degree of dryness measured by the dryness sensor 90 reaches the target degree of dryness, the control unit 120 determines whether a first dry time ($t_1$) passes after the first dry process starts (845).

If a result of determination in operation 845 is that the first dry time ($t_1$) does not pass after the first dry process (NO from 845), the control unit 120 maintains the temperature of the inside of the dry tub 20 at the first dry temperature ($T_1$) until the first dry time ($t_1$) passes. The reason why the first dry time ($t_1$) needs to wait to pass even after the degree of dryness of the substance reaches the target degree of dryness is to cover inaccuracy of the dryness sensor. That is, when the degree of dryness is measured using the dryness sensor, the measured value may be inaccurate. Accordingly, even if the target degree of dryness is achieved, the first dry process continues until the first dry time ($t_1$) passes.

If a result of determination in operation 845 is that the first dry time ($t_1$) passes after the first dry process starts, the control unit 120 allows the temperature of the inside of the dry tub 20 to be maintained at the first dry temperature ($T_1$) by repeating turning on and off the third heater 83.

If a result of determination in operation 840, the degree of dryness being measured by the dryness sensor 90 reaches the target degree of dryness, the control unit 220 starts a second dry process by raising the operation temperature of the third heater 83 (850). The reason why the control unit 220 raises the third heater 83 is to raise the temperature of the inside of the dry tub 20 from the first dry temperature ($T_1$) to the second dry temperature ($T_2$).

Thereafter, the control unit 220 determines whether the temperature at the inside of the dry tub 20 being measured by the temperature sensor 95 reaches the second dry temperature ($T_2$) (860).

If a result of determination in operation 860 is that the temperature at the inside of the dry tub 20 does not reach the second dry temperature ($T_2$), the control unit 220 keeps monitoring the temperature measured by the temperature sensor 95.

If a result of determination in operation 860 is that the temperature at the inside of the dry tub 20 reaches the second dry temperature ($T_2$), the control unit 220 maintains the temperature at the inside of the dry tub 20 at the second dry temperature ($T_2$) by repeating turning on and off the third heater 83 (870).

After operation 870, the control unit 120 determines whether a second dry time ($t_2$) allocated to the second dry process passes after the second dry process starts (880).

If a result of determination in operation 880 is that the second dry time ($t_2$) does not pass after the second dry process starts, the control unit 120 maintains the temperature at the inside of the dry tub 20 at the second dry temperature ($T_2$) by repeating turning on and off the third heater 83.

If a result of determination in operation 880 is that the second dry time ($t_2$) passes after the second dry process starts, the control unit 120 controls the operation of the clothes dryer 1 such that the cooling process is performed (890). In the cooling process, the third heater 83 is turned off, and only the blower fan 61 operates. By only operating the blower fan 61, the heat inside the dry tub 20 is discharged to the outside the clothes dryer, so that the temperature at the inside of the dry tub 20 is lowered.

Hereinabove, the embodiments of the present disclosure have been described. Although the descriptions have been made in relation to a case that a command to control the operation of the clothes dryer is received through the input unit 110 or 210, the clothes dryer may further include a receiving unit (not shown). The receiving unit may receive a remote control signal being transmitted from a remote controller. The control signal transmitting/receiving between the remote controller and the receiving unit may be achieved in a wireless communication or a wired communication. In addition, the remote controller may be an additional apparatus provided to control only the operation of the clothes dryer. Alternatively, the remote controller may be an apparatus to control the operation of home appliances on the premises while being connected to the home appliances.

The disclosure can also be embodied as computer readable medium including computer readable codes/commands to control at least one component of the above described embodiments. The medium is any medium that can store and/or transmit the computer readable code.

The computer readable code may be recorded on the medium, and examples of the medium include read-only memory (ROM), random-access memory (RAM), CD-ROMs, magnetic tapes, floppy disks and optical data storage devices. The medium can also be distributed over network coupled computer systems so that the computer readable code is stored and executed in a distributed fashion. In addition, examples of the component to be processed may include a processor or a computer process. The element to be processed may be distributed and/or included in one device.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A method of controlling a clothes dryer, the method comprising:

selecting functional clothes as a substance accommodated in a dry tub to be dried, the functional clothes comprising at least one of a moisture penetrating and water repellant material and a stretchy material;

performing a first dry process to dry the functional clothes at a first dry temperature; and performing a second dry process to dry the functional clothes at a second dry temperature higher than the first dry temperature, wherein the first dry temperature is a temperature that recovers a water repellant function of the moisture penetrating and water repellant material, wherein the first dry process is performed during a first dry time, and wherein the second dry process is performed during a second dry time, and the second dry time is a period of time that prevents the stretchy material from being deformed when the stretch material is exposed to the second dry temperature.

2. The method of claim 1, wherein the performing of the first dry process comprises:

turning on more than one heater; and maintaining a temperature at an inside of the dry tub at the first dry temperature by repeating turning on and off the more than one heater, if the temperature at the inside of the dry tub reaches the first dry temperature.

3. The method of claim 2, wherein the maintaining of the temperature at the inside of the dry tub at the first dry temperature comprises:

repeating turning on and off a second heater having a power capacity larger than a first heater in a state that the first heater is being turned on.

4. The method of claim 1, wherein the performing of the second dry process comprises:

raising an operation temperature of more than one heater, if a degree of dryness of the substance reaches a target degree of dryness in the first dry process; and maintaining a temperature at an inside of the dry tub at the second dry temperature by repeating turning on and off the more than one heater, if the temperature at the inside of the dry tub reaches the second dry temperature.

5. The method of claim 4, wherein the maintaining of the temperature at the inside of the dry tub at the second dry temperature comprises:

repeating turning on and off a second heater having a power capacity larger than a first heater in a state that the first heater is being turned on.

6. A clothes dryer comprising:

a body;

a dry tub configured to accommodate a substance to be dried, the substance including functional clothes, the functional clothes comprising at least one of a moisture penetrating and water repellant material and a stretchy material; and a control unit to control clothes dryer, wherein the control unit is configured to dry functional clothes by sequentially performing a first dry process to dry the substance at a first dry temperature and a second dry process to dry the substance at a second dry temperature higher than the first dry temperature, wherein the first dry temperature is a temperature that recovers a water repellant function of the moisture penetrating and water repellant material, and wherein the control unit is further configured to perform the first dry process during a first dry time, and to perform the second dry process during a second dry time, the second dry time being a period of time configured to prevent the stretchy material from being deformed when the stretch material is exposed to the second dry temperature.

7. The clothes dryer of claim 6, wherein the heating unit comprises more than one heater, and wherein the control unit is further configured to turn on the more than one heater, and if a temperature at the inside of the dry tub reaches the first dry temperature by the more than one heater, maintain the temperature at an inside of the dry tub at the first dry temperature by repeating turning on and off the more than one heater.

8. The clothes dryer of claim 7, wherein the more than heater comprises a first heater and a second heater, and wherein the control unit maintains the temperature at the inside of the dry tub at the first dry temperature by repeating turning on and off the second heater having a power capacity larger than the first heater in a state that the first heater is being turned on.

9. The clothes dryer of claim 6, wherein the control unit is configured to raise an operation temperature of the more than one heater if a degree of dryness of the substance reaches a target degree of dryness in the first dry process, and if the temperature at the inside of the dry tub reaches the second dry temperature, maintain the temperature at an inside of the dry tub at the second dry temperature by repeating turning on and off the more than one heater.

10. The clothes dryer of claim 9, wherein the more than heater comprises a first heater and a second heater, and wherein the control unit maintains the temperature at the inside of the dry tub at the second temperature by repeating turning on and off the second heater having a power capacity larger than the first heater in a state that the first heater is being turned on.

11. The clothes dryer of claim 6, wherein the heating unit comprises a single heater, wherein the control unit is configured to raise an operation temperature of the single heater if a degree of dryness of the substance reaches a target degree of dryness in the first dry process, and if the temperature at the inside of the dry tub reaches the second dry temperature, maintain the temperature at an inside of the dry tub at the second dry temperature by repeating turning on and off the single heater.

* * * * *